US009790965B2

(12) United States Patent
Joung et al.

(10) Patent No.: US 9,790,965 B2
(45) Date of Patent: Oct. 17, 2017

(54) HYDRAULIC SYSTEM FOR CONSTRUCTION MACHINE, PROVIDED WITH PROTECTION DEVICE

(71) Applicants: VOLVO CONSTRUCTION EQUIPMENT AB, Eskilstuna (SE); Hea-Gyoon Joung, Busan (KR); Sung-Gon Kim, Gyeongsangnam-do (KR)

(72) Inventors: Hea-Gyoon Joung, Busan (KR); Sung-Gon Kim, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 155 days.

(21) Appl. No.: 14/768,285

(22) PCT Filed: Feb. 19, 2013

(86) PCT No.: PCT/KR2013/001286
§ 371 (c)(1),
(2) Date: Aug. 17, 2015

(87) PCT Pub. No.: WO2014/129676
PCT Pub. Date: Aug. 28, 2014

(65) Prior Publication Data

US 2016/0003265 A1 Jan. 7, 2016

(51) Int. Cl.
*F15B 11/04* (2006.01)
*F15B 11/042* (2006.01)
(Continued)

(52) U.S. Cl.
CPC ..... *F15B 11/0423* (2013.01); *E02F 9/226* (2013.01); *E02F 9/2235* (2013.01);
(Continued)

(58) Field of Classification Search
CPC ..... F04B 17/05; F15B 2211/6343
(Continued)

(56) References Cited

U.S. PATENT DOCUMENTS 6,655,135 B2 * 12/2003 Oka ..... F04B 49/065 60/329
7,082,758 B2 * 8/2006 Kageyama ..... E02F 9/20 60/329
(Continued)

FOREIGN PATENT DOCUMENTS

CN 101900153 A 12/2010
EP 1267075 A2 12/2002
(Continued)

OTHER PUBLICATIONS

International Search Report (in English and Korean) and Written Opinion of the International Searching Authority (Korean) for PCT/KR2013/001286, mailed Jun. 21, 2013; ISA/KR.
(Continued)

*Primary Examiner* — Thomas E Lazo
(74) *Attorney, Agent, or Firm* — Harness, Dickey & Pierce, P.L.C.

(57) ABSTRACT

A hydraulic system for a construction machine having a protection device is disclosed, which can limit a flow rate of hydraulic fluid that is discharged from a hydraulic pump in accordance with a hydraulic fluid temperature and notify an operator of information on the hydraulic fluid temperature. The hydraulic system for a construction machine includes a hydraulic actuator operated by hydraulic fluid that is supplied from a hydraulic pump; a control valve installed in a flow path between the hydraulic pump and the hydraulic actuator to control a flow rate of the hydraulic fluid that is supplied from the hydraulic pump to the hydraulic actuator; an oil cooler installed in a return flow path from the control valve to an hydraulic fluid tank to cool the hydraulic fluid;
(Continued)

a hydraulic fluid temperature sensor detecting in real time a hydraulic fluid temperature of the hydraulic fluid tank; a hydraulic pump regulator controlling a discharge flow rate of the hydraulic pump through adjustment of an inclination angle of a swash plate of the hydraulic pump; and a controller comparing the hydraulic fluid temperature detected by the hydraulic fluid temperature sensor with a predetermined hydraulic fluid temperature, and outputting a control signal to the hydraulic pump regulator so as to limit the discharge flow rate of the hydraulic pump to or below a predetermined flow rate if the detected hydraulic fluid temperature is equal to or lower than a predetermined lower limit value, or equal to or higher than a predetermined upper limit value.

8 Claims, 6 Drawing Sheets

(51) Int. Cl.
*E02F 9/22* (2006.01)
*F15B 20/00* (2006.01)

(52) U.S. Cl.
CPC ..... *E02F 9/2296* (2013.01); *F15B 20/00* (2013.01); *F15B 2211/20546* (2013.01); *F15B 2211/3116* (2013.01); *F15B 2211/40* (2013.01); *F15B 2211/45* (2013.01); *F15B 2211/611* (2013.01); *F15B 2211/62* (2013.01); *F15B 2211/6343* (2013.01); *F15B 2211/6652* (2013.01)

(58) Field of Classification Search
USPC ..... 60/431, 445
See application file for complete search history.

(56) References Cited

U.S. PATENT DOCUMENTS 8,407,994 B2 * 4/2013 Kamoshida ..... E02F 9/226 60/431
8,424,298 B2 * 4/2013 Ariga ..... E02F 9/2225 60/329
8,818,651 B2 8/2014 Joung et al.
9,103,355 B2 8/2015 Ku et al.
2002/0184881 A1 * 12/2002 Oka ..... F04B 49/065 60/329
2006/0236689 A1 * 10/2006 Kim ..... E02F 9/2235 60/456
2013/0098021 A1 4/2013 Shin et al.
2013/0121852 A1 5/2013 Joung et al.
2014/0010688 A1 1/2014 Kim
2014/0238010 A1 8/2014 Joung et al.
2014/0325975 A1 11/2014 Kim et al.

FOREIGN PATENT DOCUMENTS

EP 1715193 A2 10/2006
JP H05-280070 A 10/1993
JP H09-177724 A 7/1997
JP 2001-041204 A 2/2001
JP 2002-364603 A 12/2002
JP 2010-270647 A 12/2010
KR 19950003643 2/1995
KR 20100130034 A 12/2010

OTHER PUBLICATIONS

Office Action (in Chinese) issued by the State Intellectual Property Office (SIPO) of People's Republic of China on Nov. 15, 2016 concerning the corresponding China patent application (8 pages).
First Office Action issued by the State Intellectual Property Office (SIPO) on Mar. 23, 2016 regarding corresponding patent application No. 201380072836.6 in China (with English translation). (20 pages).
Extended European Search Report issued by the European Patent Office (EPO) on Oct. 24, 2016 regarding corresponding EP Patent Application No. 13875723.2 (9 pages).
Notification of Reason for Refusal (in Korean) issued by the Korean Intellectual Property Office (KIPO) on Nov. 25, 2016 regarding corresponding Korean Patent Application (7 pages).

* cited by examiner

Prior Art

HYDRAULIC SYSTEM FOR CONSTRUCTION MACHINE, PROVIDED WITH PROTECTION DEVICE

CROSS-REFERENCE TO RELATED APPLICATION

This application is a 371 U.S. National Stage of International Application No. PCT/KR2013/001286, filed on Feb. 19, 2013. The entire disclosure of the above application is hereby incorporated by reference.

TECHNICAL FIELD

The present invention relates to a hydraulic system for a construction machine having a protection device, and more particularly to a hydraulic system for a construction machine having a protection device, which can limit a flow rate of hydraulic fluid that is discharged from a hydraulic pump in accordance with a hydraulic fluid temperature of the hydraulic fluid that operates a hydraulic actuator and notify an operator of information on the hydraulic fluid temperature.

BACKGROUND OF THE INVENTION

As illustrated in FIG. 1, a hydraulic system for a construction machine in the related art includes a variable displacement hydraulic pump 2 (hereinafter referred to as "hydraulic pump") operated by an engine 1, a hydraulic actuator 3 (e.g., boom cylinder) operated by hydraulic fluid that is supplied from the hydraulic pump 2, a control valve (MCV) 4 installed in a flow path between the hydraulic pump 2 and the hydraulic actuator 3 to control a flow rate of the hydraulic fluid that is supplied from the hydraulic pump 2 to the hydraulic actuator 3 when a spool thereof is shifted, an oil cooler 7 installed in a return flow path 6 from the control valve 4 to a hydraulic fluid tank 5 to cool the hydraulic fluid that returns to the hydraulic fluid tank 5, a hydraulic pump regulator 8 controlling a discharge flow rate of the hydraulic pump 2 through adjustment of an inclination angle of a swash plate of the hydraulic pump 2, and a controller 9 outputting a control signal to the hydraulic pump regulator 8 or an engine revolution control device (not illustrated) of the engine 1 so as to limit the discharge flow rate of the hydraulic pump 2 to a predetermined flow rate.

The hydraulic system for a construction machine in the related art as described above operates to lower the hydraulic fluid temperature through heightening of the rotating speed of a cooling fan if the hydraulic fluid temperature of the hydraulic fluid tank 15 exceeds a predetermined upper limit value and to make the hydraulic fluid temperature belong to a certain temperature range between a lower limit value and the upper limit value through lowering of the rotating speed of the cooling fan if the hydraulic fluid temperature is lower than the predetermined lower limit value.

On the other hand, if the hydraulic fluid temperature of the hydraulic fluid is low as illustrated in FIG. 2, the viscosity of the hydraulic fluid becomes relatively high, and thus the suction pressure from the hydraulic fluid tank 5 to the hydraulic pump 2 is lowered to cause a pressure loss to occur. Due to this, in the case of abruptly operating working devices (including a boom, an arm, and a bucket) of the equipment in a state where the hydraulic fluid temperature is lower than the predetermined lower limit value, the suction pressure of the hydraulic pump 2 becomes lowered, and a cavitation phenomenon may occur. If the cavitation phenomenon occurs, the hydraulic pump 2 may be damaged or the hydraulic system of the equipment may be damaged.

Further, in the case where the atmospheric temperature is increased to an abnormally high temperature, or the hydraulic fluid temperature is excessively increased over the cooling capability of the oil cooler 7 due to trouble of the oil cooler 7 or the like, hydraulic components may be damaged, or a seal for preventing oil leak that is installed on the hydraulic actuator or hydraulic pipes may be damaged to cause oil leak.

SUMMARY OF THE INVENTION

Accordingly, the present invention has been made to solve the aforementioned problems occurring in the related art, and it is an object of the present invention to provide a hydraulic system for a construction machine having a protection device, which can prevent a hydraulic system that includes a hydraulic pump from being damaged by limiting a flow rate of hydraulic fluid that is discharged from the hydraulic pump in accordance with a hydraulic fluid temperature of the hydraulic fluid, and can protect the hydraulic system by warning an operator so that the operator can take proper safety measures.

TECHNICAL SOLUTION

To achieve the above objects, in accordance with a first embodiment of the present invention, there is provided a hydraulic system for a construction machine having a protection device, which includes a variable displacement hydraulic pump; a hydraulic actuator operated by hydraulic fluid that is supplied from the hydraulic pump; a control valve installed in a flow path between the hydraulic pump and the hydraulic actuator to control a flow rate of the hydraulic fluid that is supplied from the hydraulic pump to the hydraulic actuator; an oil cooler installed in a return flow path from the control valve to a hydraulic fluid tank to cool the hydraulic fluid; a hydraulic fluid temperature sensor detecting in real time a hydraulic fluid temperature of the hydraulic fluid tank; a hydraulic pump regulator controlling a discharge flow rate of the hydraulic pump through adjustment of an inclination angle of a swash plate of the hydraulic pump; and a controller comparing the hydraulic fluid temperature detected by the hydraulic fluid temperature sensor with a predetermined hydraulic fluid temperature, and outputting a control signal to the hydraulic pump regulator so as to limit the discharge flow rate of the hydraulic pump to or below a predetermined flow rate if the detected hydraulic fluid temperature is equal to or lower than a predetermined lower limit value, or equal to or higher than a predetermined upper limit value.

In accordance with a second embodiment of the present invention, there is provided a hydraulic system for a construction machine having a protection device, which includes a variable displacement hydraulic pump operated by an engine; a hydraulic actuator operated by hydraulic fluid that is supplied from the hydraulic pump; a control valve installed in a flow path between the hydraulic pump and the hydraulic actuator to control a flow rate of the hydraulic fluid that is supplied from the hydraulic pump to the hydraulic actuator; an oil cooler installed in a return flow path from the control valve to a hydraulic fluid tank to cool the hydraulic fluid; a hydraulic fluid temperature sensor detecting in real time a hydraulic fluid temperature of the hydraulic fluid tank; a hydraulic pump regulator controlling a discharge flow rate of the hydraulic pump through adjustment of an inclination angle of a swash plate of the hydraulic pump; and a controller comparing the hydraulic fluid temperature detected by the hydraulic fluid temperature sensor with a predetermined hydraulic fluid temperature, and outputting a control signal to an engine revolution control device of the engine so as to limit the discharge flow rate of the hydraulic pump to or below a predetermined flow rate through adjustment of an engine revolution of the engine if the detected hydraulic fluid temperature is equal to or lower than a predetermined lower limit value, or equal to or higher than a predetermined upper limit value.

In accordance with a third embodiment of the present invention, there is provided a hydraulic system for a construction machine having a protection device, which includes a variable displacement hydraulic pump; a hydraulic actuator operated by hydraulic fluid that is supplied from the hydraulic pump; a control valve installed in a flow path between the hydraulic pump and the hydraulic actuator to control a flow rate of the hydraulic fluid that is supplied from the hydraulic pump to the hydraulic actuator; an oil cooler installed in a return flow path from the control valve to a hydraulic fluid tank to cool the hydraulic fluid; a hydraulic fluid temperature sensor detecting in real time a hydraulic fluid temperature of the hydraulic fluid tank; a hydraulic pump regulator controlling a discharge flow rate of the hydraulic pump through adjustment of an inclination angle of a swash plate of the hydraulic pump; a pressure detection sensor detecting pressure of the hydraulic pump; a flow rate detection sensor detecting the discharge flow rate of the hydraulic pump; and a controller comparing the hydraulic fluid temperature detected by the hydraulic fluid temperature sensor with a predetermined hydraulic fluid temperature, calculating a torque in accordance with the detected discharge flow rate and pressure of the hydraulic pump if the detected hydraulic fluid temperature is equal to or lower than a predetermined lower limit value, or equal to or higher than a predetermined upper limit value, and outputting a control signal to the hydraulic pump regulator so as to limit the discharge flow rate of the hydraulic pump to or below a predetermined flow rate through reduction of an input torque value of the hydraulic pump against the calculated torque value with a predetermined ratio.

The controller may include a control means for controlling the discharge flow rate of the hydraulic pump in accordance with the hydraulic fluid temperature detected by the hydraulic fluid temperature sensor, checking the hydraulic fluid temperature in real time, and releasing the function of limiting the discharge flow rate of the hydraulic pump to or below the predetermined flow rate if the detected hydraulic fluid temperature belongs to a certain temperature range between the lower limit value and the upper limit value.

The controller may include a warning means for notifying an operator on an operator's seat of information on the hydraulic fluid temperature if the detected hydraulic fluid temperature, which is input from the hydraulic fluid temperature sensor to the controller, is equal to or lower than the predetermined lower limit value, or equal to or higher than the predetermined upper limit value.

Any one of an alarm, a buzzer, and a sound message may be used as the warning means.

Advantageous Effect

According to embodiments of the present invention having the above-described configuration, the hydraulic system that includes the hydraulic pump can be prevented from being damaged due to the cavitation that occurs when the hydraulic fluid temperature is lower than the lower limit value, and the oil leak can be prevented, which occurs due to the damage of the hydraulic components or the seal that occurs when the hydraulic fluid temperature is higher than the upper limit value. Further, since the operator is notified of the hydraulic fluid temperature information, the operator can take proper safety measures to protect the hydraulic system.

BRIEF DESCRIPTION OF THE DRAWINGS

The above objects, other features and advantages of the present invention will become more apparent by describing the preferred embodiments thereof with reference to the accompanying drawings, in which.

EXPLANATION OF REFERENCE NUMERALS FOR MAIN PARTS IN THE DRAWING

Figure 1:
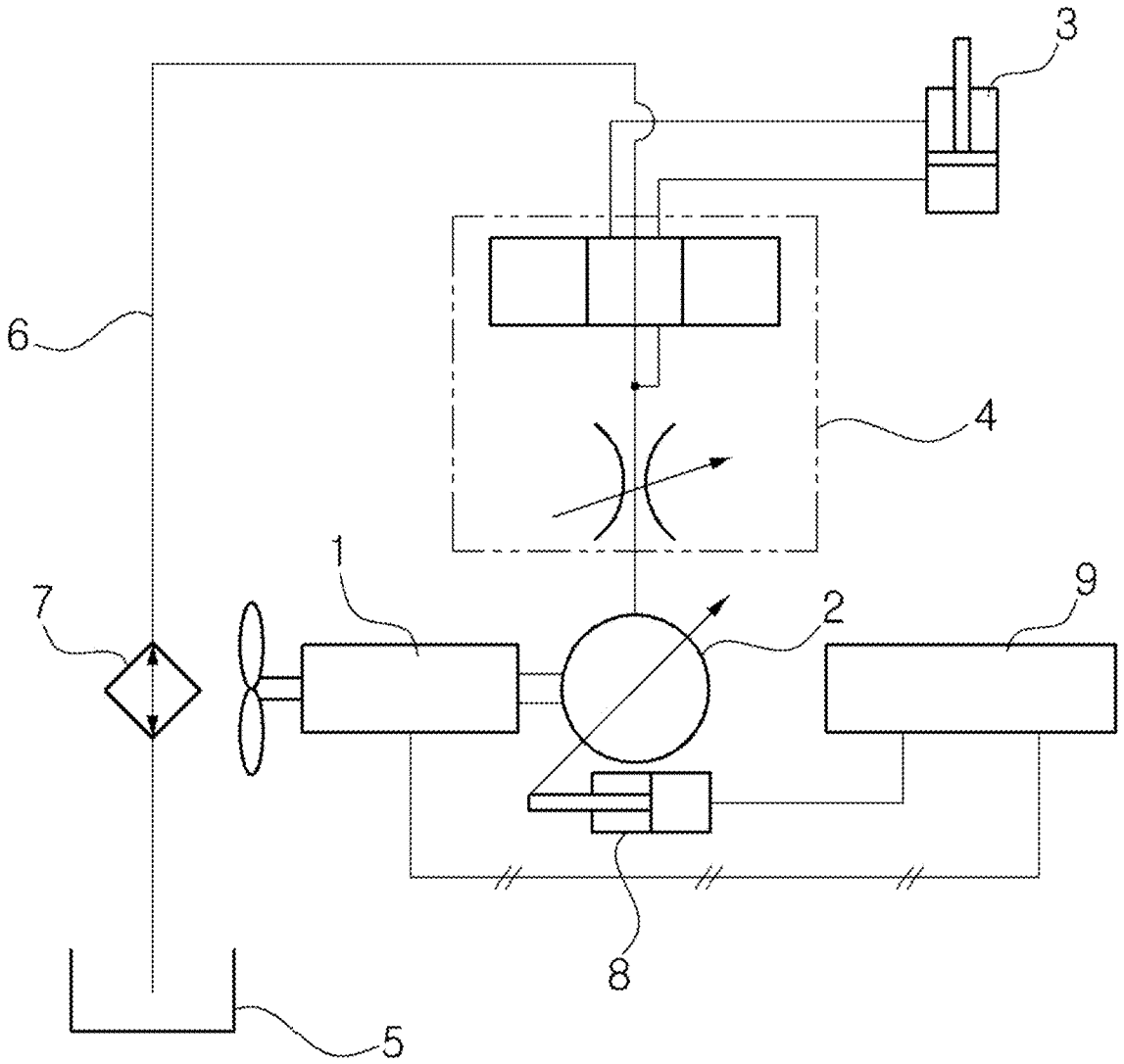
FIG. 1 is a hydraulic circuit diagram of a hydraulic system for a construction machine in the related art.
Figure 2:
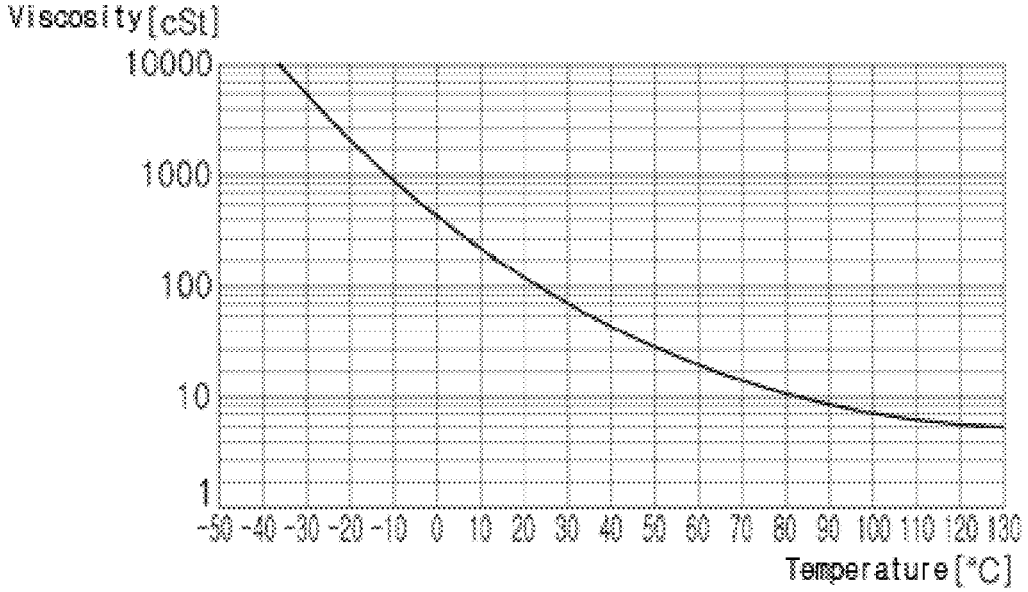
FIG. 2 is a graph explaining the relationship between hydraulic fluid temperature of hydraulic fluid that is used in a hydraulic system for a construction machine and viscosity.

11: engine
12: hydraulic pump
13: hydraulic actuator
14: control valve (MCV)
15: hydraulic fluid tank
16: return flow path
17: oil cooler
18: hydraulic pump regulator
19: controller
20: hydraulic fluid temperature sensor

DETAILED DESCRIPTION OF THE INVENTION

Hereinafter, a hydraulic system for a construction machine having a protection device in accordance with preferred embodiments of the present invention will be described in detail with reference to the accompanying drawings.

Figure 3:
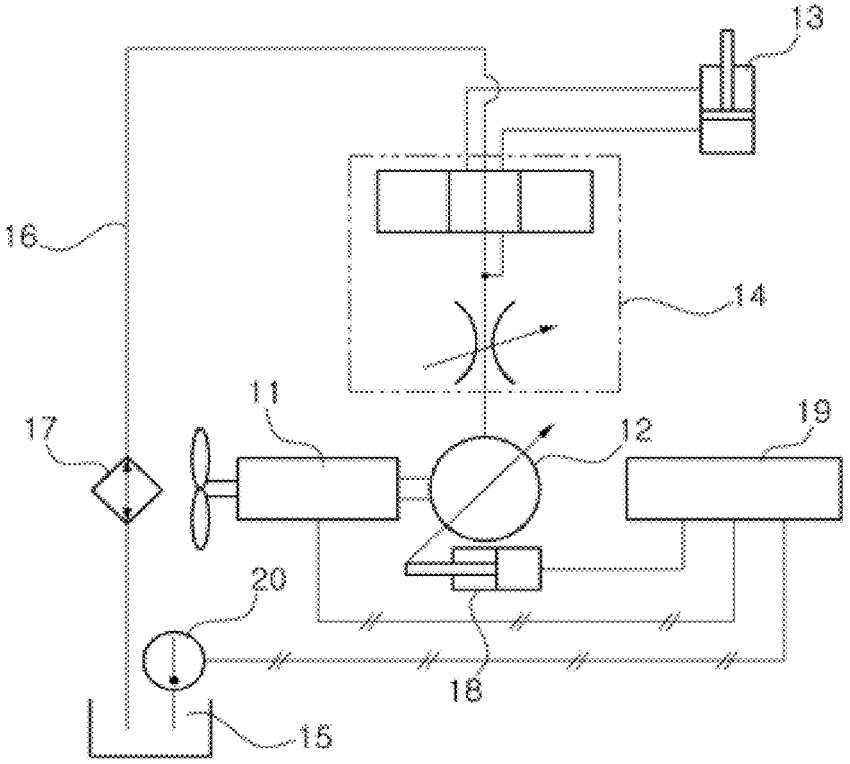
FIG. 3 is a hydraulic circuit diagram of a hydraulic system for a construction machine having a protection device according to a first preferred embodiment of the present invention.
Figure 4:
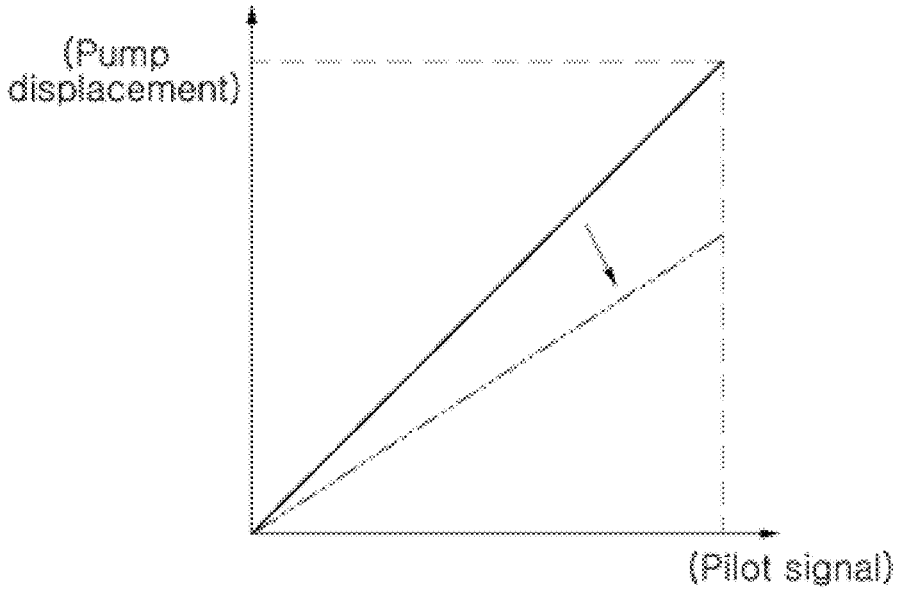
FIG. 4 is a diagram explaining the displacement volume control characteristic of a hydraulic pump in a hydraulic system for a construction machine having a protection device according to a first preferred embodiment of the present invention.
Figure 5:
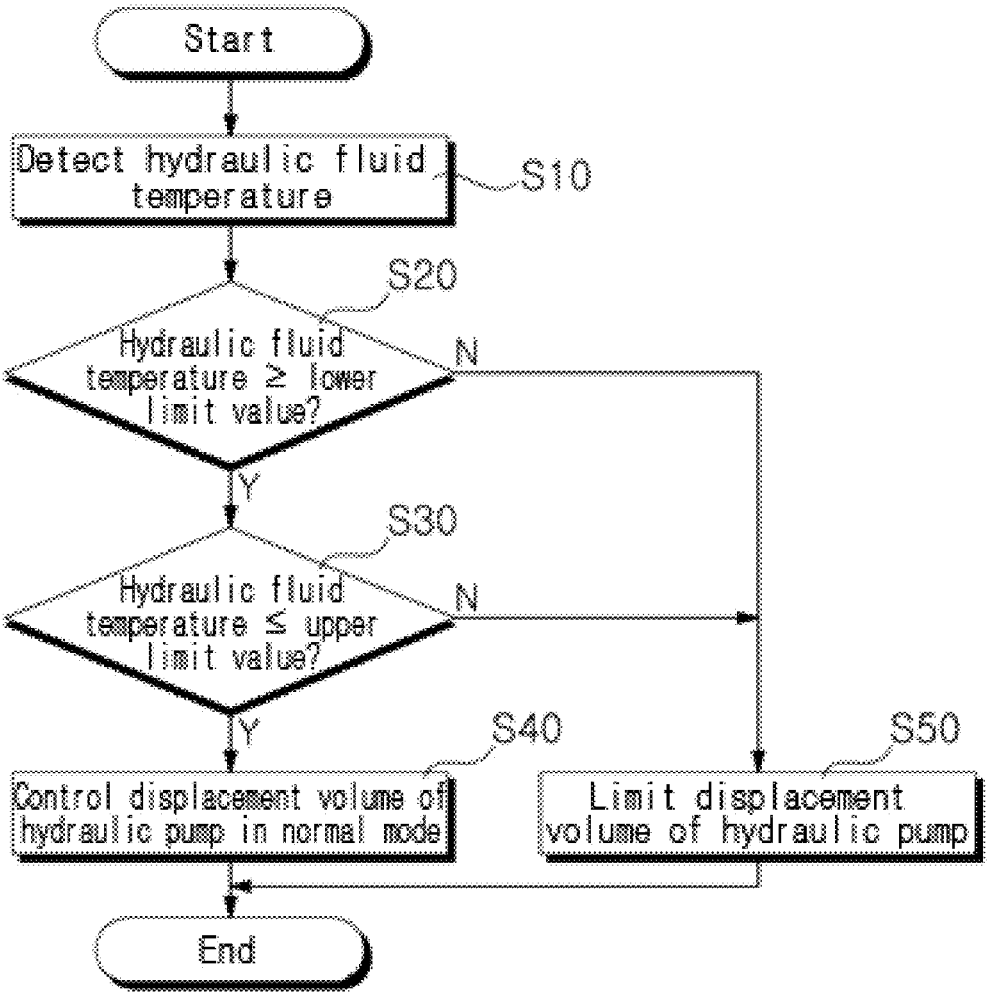
FIG. 5 is a flowchart explaining displacement volume control of a hydraulic pump in a hydraulic system for a construction machine having a protection device according to a first preferred embodiment of the present invention.
Figure 6:
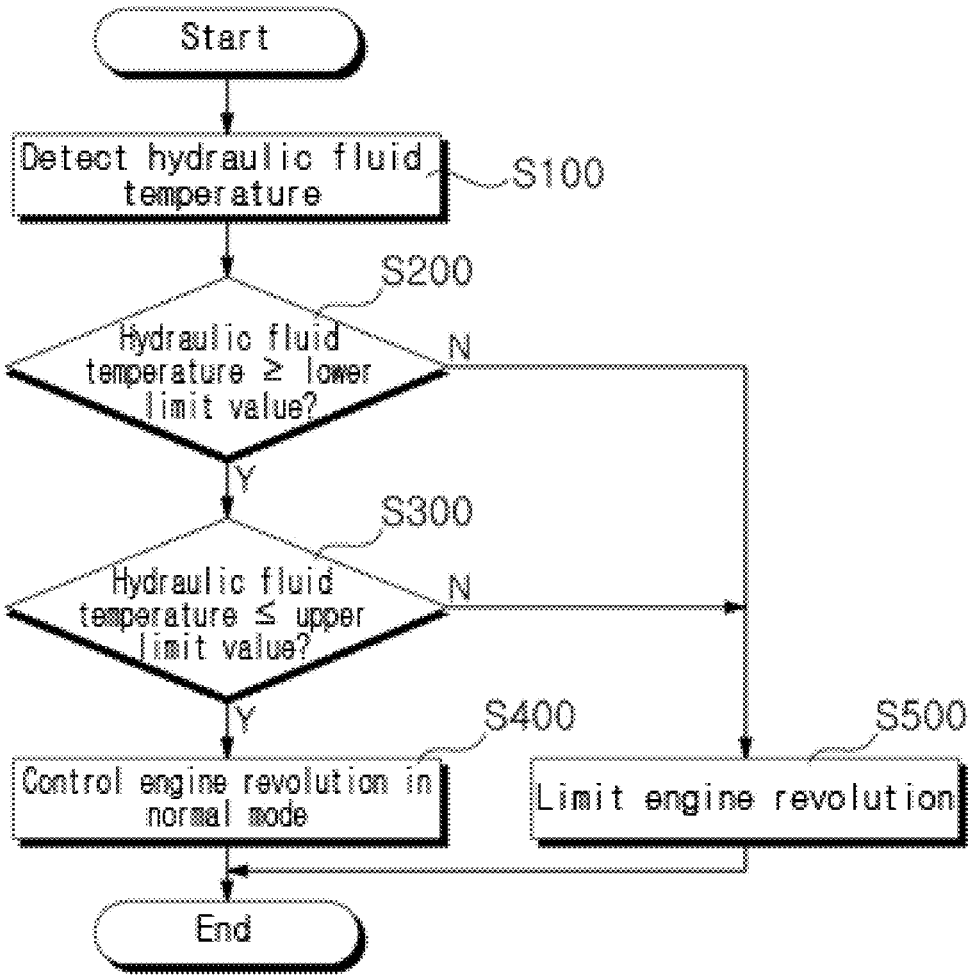
FIG. 6 is a flowchart explaining engine revolution control in a hydraulic system for a construction machine having a protection device according to a second preferred embodiment of the present invention.
Figure 7:
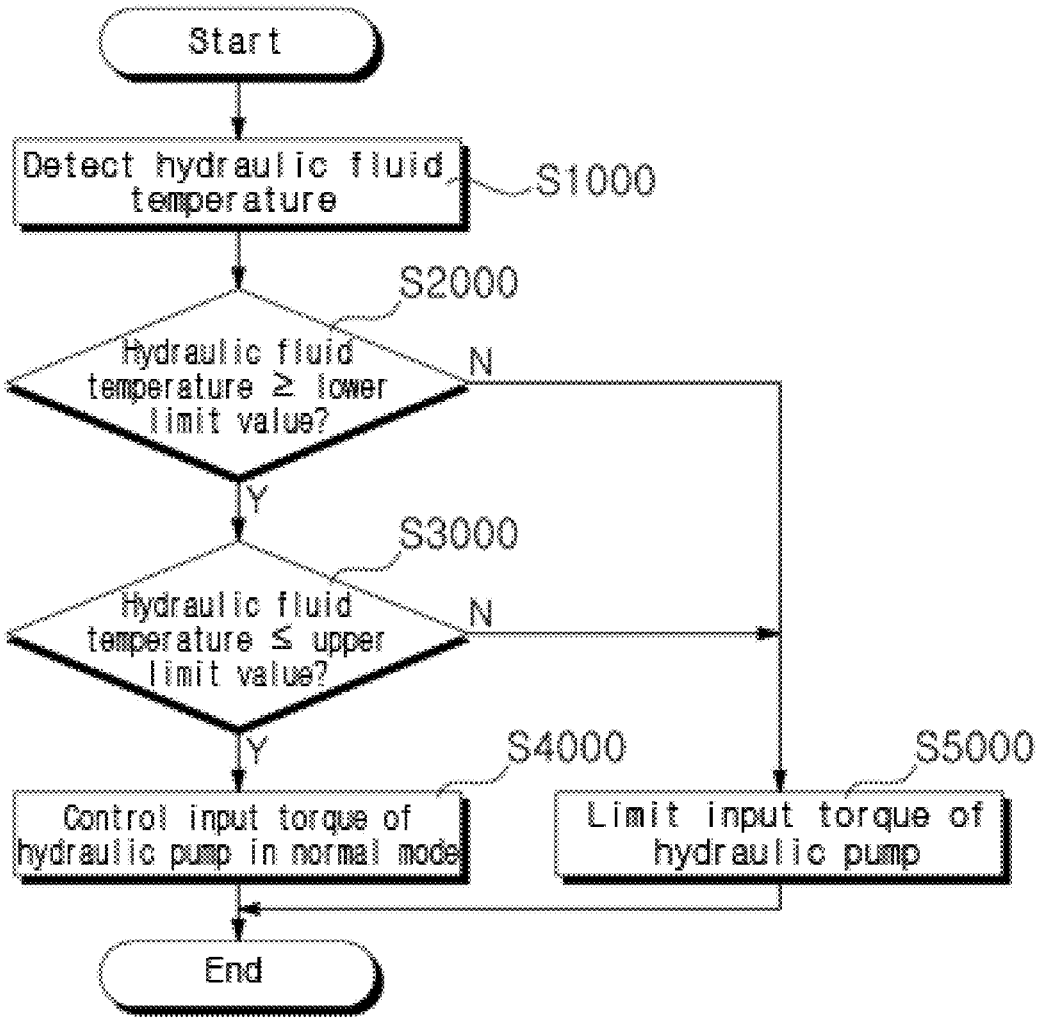
FIG. 7 is a flowchart explaining input torque control of a hydraulic pump in a hydraulic system for a construction machine having a protection device according to a second preferred embodiment of the present invention.

FIG. 3 is a hydraulic circuit diagram of a hydraulic system for a construction machine having a protection device according to a first preferred embodiment of the present invention, and FIG. 4 is a diagram explaining the displacement volume control characteristic of a hydraulic pump in a hydraulic system for a construction machine having a protection device according to a first preferred embodiment of the present invention. FIG. 5 is a flowchart explaining displacement volume control of a hydraulic pump in a hydraulic system for a construction machine having a protection device according to a first preferred embodiment of the present invention, FIG. 6 is a flowchart explaining engine revolution control in a hydraulic system for a construction machine having a protection device according to a second preferred embodiment of the present invention, and FIG. 7 is a flowchart explaining input torque control of a hydraulic pump in a hydraulic system for a construction machine having a protection device according to a second preferred embodiment of the present invention.

Referring to FIGS. 3 to 5, a hydraulic system for a construction machine having a protection device according to a first embodiment of the present invention includes a variable displacement hydraulic pump 2 (hereinafter referred to as "hydraulic pump") operated by an engine 1; a hydraulic actuator 3 (e.g., boom cylinder) operated by hydraulic fluid that is supplied from the hydraulic pump 2; a control valve (MCV) 14 installed in a flow path between the hydraulic pump 12 and the hydraulic actuator 13 to control a flow rate of the hydraulic fluid that is supplied from the hydraulic pump 12 to the hydraulic actuator 13; an oil cooler 17 installed in a return flow path 16 from the control valve 14 to a hydraulic fluid tank 15 to cool the hydraulic fluid that returns to the hydraulic fluid tank 15; a hydraulic fluid temperature sensor 20 detecting in real time a hydraulic fluid temperature of the hydraulic fluid tank 15; a hydraulic pump regulator 18 controlling a discharge flow rate of the hydraulic pump 12 through adjustment of an inclination angle of a swash plate of the hydraulic pump 12; and a controller 19 comparing the hydraulic fluid temperature that is detected by the hydraulic fluid temperature sensor 20 with a predetermined hydraulic fluid temperature, and outputting a control signal for controlling a displacement volume of the hydraulic pump 12 to the hydraulic pump regulator 18 so as to limit the discharge flow rate of the hydraulic pump 12 to or below a predetermined flow rate if the detected hydraulic fluid temperature is equal to or lower than a predetermined lower limit value, or equal to or higher than a predetermined upper limit value.

The controller 19 may include a control means (not illustrated) for controlling the discharge flow rate of the hydraulic pump 12 in accordance with the hydraulic fluid temperature detected by the hydraulic fluid temperature sensor 20, checking the hydraulic fluid temperature in real time, and releasing the function of limiting the discharge flow rate of the hydraulic pump 12 to or below the predetermined flow rate if the detected hydraulic fluid temperature belongs to a certain temperature range between the lower limit value and the upper limit value.

The controller 19 may include a warning means (not illustrated) for notifying an operator on an operator's seat of information on the hydraulic fluid temperature if the detected hydraulic fluid temperature, which is input from the hydraulic fluid temperature sensor (20) to the controller 19, is equal to or lower than the predetermined lower limit value, or equal to or higher than the predetermined upper limit value.

Any one of an alarm, a buzzer, and a sound message may be used as the warning means.

According to the hydraulic system for a construction machine according to the first embodiment of the present invention as described above, the hydraulic fluid temperature of the hydraulic fluid tank 15 is detected by the hydraulic fluid temperature sensor 20, and the detected hydraulic fluid temperature value is output to the controller 19 (S10).

At S20, the hydraulic fluid temperature that is input to the controller 19 and the predetermined hydraulic fluid temperature are compared with each other. If the detected hydraulic fluid temperature is equal to or higher than the predetermined lower limit value, the processing proceeds to S30, whereas if the detected hydraulic fluid temperature is lower than the predetermined lower limit value, the processing proceeds to S50.

At S30, the hydraulic fluid temperature that is input to the controller 19 and the predetermined hydraulic fluid temperature are compared with each other. If the hydraulic fluid temperature that is detected by the hydraulic fluid temperature sensor 20 is equal to or lower than the predetermined upper limit value, the processing proceeds to S40, whereas if the hydraulic fluid temperature that is detected by the hydraulic fluid temperature sensor 20 is higher than the predetermined upper limit value, the processing proceeds to S50.

At S40, if the hydraulic fluid temperature that is input to the controller 19 belongs to a certain temperature range between the predetermined lower limit value and the predetermined upper limit value, the controller 19 determines that the hydraulic fluid temperature of the hydraulic fluid is at a normal level. Accordingly, the hydraulic fluid of the hydraulic pump 12 is discharged with the predetermined flow rate corresponding to the control signal that is input from the controller 19 to the hydraulic pump regulator 18.

At S50, if the hydraulic fluid temperature that is input to the controller 19 is equal to or lower than the predetermined lower limit value (S20) or is equal to or higher than the predetermined upper limit value (S30), the controller 19 determines that the hydraulic fluid temperature of the hydraulic fluid deviates from the normal level. Accordingly, if the hydraulic fluid temperature that is input to the controller 19 is equal to or lower than the predetermined lower limit value, the inclination angle of the swash plate of the hydraulic pump 12 is limited by the control signal that is input from the controller 19 to the hydraulic pump regulator 18 to limit the displacement volume thereof. Through this, the discharge flow rate of the hydraulic pump 12 is limited to or below the predetermined flow rate until the hydraulic fluid temperature that is detected in real time by the hydraulic fluid temperature sensor 20 to be input to the controller 19 exceeds the predetermined lower limit value.

Further, even if the hydraulic fluid temperature that is input to the controller 19 is equal to or higher than the predetermined upper limit value, the inclination angle of the swash plate of the hydraulic pump 12 is limited by the control signal that is input from the controller 19 to the hydraulic pump regulator 18 to limit the displacement volume thereof (the displacement volume of the hydraulic pump 12 is reduced other than being in proportion to the applied pilot signal as shown in FIG. 4). Through this, the discharge flow rate of the hydraulic pump 12 is limited to or below the predetermined flow rate until the hydraulic fluid temperature that is detected in real time by the hydraulic fluid temperature sensor 20 to be input to the controller 19 becomes lower than the predetermined upper limit value.

As described above, in the case where the hydraulic fluid temperature that is detected by the hydraulic fluid temperature sensor 20 to be input to the controller 19 is equal to or lower than the predetermined lower limit value, or equal to or higher than the predetermined upper limit value, the discharge flow rate of the hydraulic pump 12 can be limited to the predetermined flow rate through limiting of the displacement volume of the hydraulic pump 12. At the same time, an operator on an operator's seat is notified of information on the hydraulic fluid temperature. Through this, the operator determines that the hydraulic fluid temperature of the hydraulic fluid deviates from the normal level, and thus can take proper safety measures to protect the hydraulic system.

Referring to FIGS. 3 and 6, a hydraulic system for a construction machine having a protection device according to a second embodiment of the present invention includes a variable displacement hydraulic pump 2 (hereinafter referred to as "hydraulic pump") operated by an engine 1; a hydraulic actuator 3 (e.g., boom cylinder) operated by hydraulic fluid that is supplied from the hydraulic pump 2; a control valve (MCV) 14 installed in a flow path between the hydraulic pump 12 and the hydraulic actuator 13 to control a flow rate of the hydraulic fluid that is supplied from the hydraulic pump 12 to the hydraulic actuator 13; an oil cooler 17 installed in a return flow path 16 from the control valve 14 to a hydraulic fluid tank 15 to cool the hydraulic fluid that returns to the hydraulic fluid tank 15; a hydraulic fluid temperature sensor 20 detecting in real time a hydraulic fluid temperature of the hydraulic fluid tank 15; a hydraulic pump regulator 18 controlling a discharge flow rate of the hydraulic pump 12 through adjustment of an inclination angle of a swash plate of the hydraulic pump 12; and a controller 19 comparing the hydraulic fluid temperature that is detected by the hydraulic fluid temperature sensor 20 with a predetermined hydraulic fluid temperature, and outputting a control signal to an engine revolution control device of the engine 11 so as to limit the discharge flow rate of the hydraulic pump 12 to or below a predetermined flow rate through adjustment of an engine revolution of the engine 11 if the detected hydraulic fluid temperature is equal to or lower than a predetermined lower limit value, or equal to or higher than a predetermined upper limit value.

In this case, since the configuration, except for the controller 19 outputting the control signal to the engine revolution control device of the engine 11 so as to limit the discharge flow rate of the hydraulic pump 12 to or below the predetermined flow rate through adjustment of the engine revolution of the engine 11 if the detected hydraulic fluid temperature is equal to or lower than the predetermined lower limit value, or equal to or higher than the predetermined upper limit value, is the same as the configuration of the hydraulic system for a construction machine having a protection device according to the first embodiment of the present invention, the detailed explanation thereof will be omitted.

According to the hydraulic system for a construction machine according to the second embodiment of the present invention as described above, the hydraulic fluid temperature of the hydraulic fluid tank 15 is detected by the hydraulic fluid temperature sensor 20, and the detected hydraulic fluid temperature value is output to the controller 19 (S100).

At S200, the hydraulic fluid temperature that is input to the controller 19 and the predetermined hydraulic fluid temperature are compared with each other. If the hydraulic fluid temperature that is detected by the hydraulic fluid temperature sensor 20 is equal to or higher than the predetermined lower limit value, the processing proceeds to S300, whereas if the hydraulic fluid temperature that is detected by the hydraulic fluid temperature sensor 20 is lower than the predetermined lower limit value, the processing proceeds to S500.

At S300, the hydraulic fluid temperature that is input to the controller 19 and the predetermined hydraulic fluid temperature are compared with each other. If the hydraulic fluid temperature that is detected by the hydraulic fluid temperature sensor 20 is equal to or lower than the predetermined upper limit value, the processing proceeds to S400, whereas if the hydraulic fluid temperature that is detected by the hydraulic fluid temperature sensor 20 is higher than the predetermined upper limit value, the processing proceeds to S500.

At S400, if the hydraulic fluid temperature that is input to the controller 19 belongs to a certain temperature range between the predetermined lower limit value and the predetermined upper limit value, the controller 19 determines that the hydraulic fluid temperature of the hydraulic fluid is at a normal level. Accordingly, the hydraulic fluid of the hydraulic pump 12 is discharged with the predetermined flow rate corresponding to the control signal that is input from the controller 19 to the hydraulic pump regulator 18.

At S500, if the hydraulic fluid temperature that is input to the controller 19 is equal to or lower than the predetermined lower limit value (S200) or is equal to or higher than the predetermined upper limit value (S300), the controller 19 determines that the hydraulic fluid temperature of the hydraulic fluid deviates from the normal level. Accordingly, if the hydraulic fluid temperature that is input to the controller 19 is equal to or lower than the predetermined lower limit value, the engine revolution of the engine 11 is lowered by the control signal that is input from the controller 19 to the engine revolution control device so as to limit the discharge flow rate of the hydraulic pump 12 through the adjustment of the engine revolution. Through this, the discharge flow rate of the hydraulic pump 12 is limited to or below the predetermined flow rate until the hydraulic fluid temperature that is detected in real time by the hydraulic fluid temperature sensor 20 to be input to the controller 19 exceeds the predetermined lower limit value.

Further, even if the hydraulic fluid temperature that is input to the controller 19 is equal to or higher than the predetermined upper limit value, the revolution of the engine 11 is lowered by the control signal that is input from the controller 19 to the engine revolution control device so as to limit the discharge flow rate of the hydraulic pump 12 through adjustment of the engine revolution. Through this, the discharge flow rate of the hydraulic pump 12 is limited to or below the predetermined flow rate until the hydraulic fluid temperature that is detected in real time by the hydraulic fluid temperature sensor 20 to be input to the controller 19 becomes lower than the predetermined upper limit value.

As described above, in the case where the hydraulic fluid temperature that is detected by the hydraulic fluid temperature sensor 20 to be input to the controller 19 is equal to or lower than the predetermined lower limit value, or equal to or higher than the predetermined upper limit value, the discharge flow rate of the hydraulic pump 12 can be limited to the predetermined flow rate by lowering the revolution of the engine 11 through control of the engine revolution control device. At the same time, since the operator on the operator's seat is notified of the information on the hydraulic fluid temperature, the operator can take proper safety measures.

Referring to FIGS. 3 and 7, a hydraulic system for a construction machine having a protection device according to a third embodiment of the present invention includes a variable displacement hydraulic pump 2 (hereinafter referred to as "hydraulic pump") operated by an engine 1; a hydraulic actuator 3 (e.g., boom cylinder) operated by hydraulic fluid that is supplied from the hydraulic pump 2; a control valve (MCV) 14 installed in a flow path between the hydraulic pump 12 and the hydraulic actuator 13 to control a flow rate of the hydraulic fluid that is supplied from the hydraulic pump 12 to the hydraulic actuator 13; an oil cooler 17 installed in a return flow path 16 from the control valve 14 to a hydraulic fluid tank 15 to cool the hydraulic fluid that returns to the hydraulic fluid tank 15; a hydraulic fluid temperature sensor 20 detecting in real time a hydraulic fluid temperature of the hydraulic fluid tank 15; a hydraulic pump regulator 18 controlling a discharge flow rate of the hydraulic pump 12 through adjustment of an inclination angle of a swash plate of the hydraulic pump 12; a pressure detection sensor (not illustrated) detecting pressure of the hydraulic pump 12; a flow rate detection sensor (not illustrated) detecting the discharge flow rate of the hydraulic pump 12; and a controller 19 comparing the hydraulic fluid temperature that is detected by the hydraulic fluid temperature sensor 20 with a predetermined hydraulic fluid temperature, calculating a torque in accordance with the detected discharge flow rate and pressure of the hydraulic pump 12 if the detected hydraulic fluid temperature is equal to or lower than a predetermined lower limit value, or equal to or higher than a predetermined upper limit value, and outputting a control signal to a hydraulic pump torque control device (not illustrated) that is provided in the hydraulic pump regulator 18 so as to limit the discharge flow rate of the hydraulic pump 12 to or below a predetermined flow rate through reduction of an input torque value of the hydraulic pump 12 against the calculated torque value with a predetermined ratio.

In this case, since the configuration, except for the controller 19 calculating the torque in accordance with the detected discharge flow rate and pressure of the hydraulic pump 12 if the hydraulic fluid temperature that is detected by the hydraulic fluid temperature sensor 20 is equal to or lower than the predetermined lower limit value, or equal to or higher than the predetermined upper limit value, and outputting the control signal to the hydraulic pump regulator 18 so as to limit the discharge flow rate of the hydraulic pump 12 to or below the predetermined flow rate through reduction of the input torque value of the hydraulic pump 12 against the calculated torque value with the predetermined ratio, is the same as the configuration of the hydraulic system for a construction machine having a protection device according to the first embodiment of the present invention, the detailed explanation thereof will be omitted.

According to the hydraulic system for a construction machine according to the third embodiment of the present invention as described above, the hydraulic fluid temperature of the hydraulic fluid tank 15 is detected by the hydraulic fluid temperature sensor 20, and the detected hydraulic fluid temperature value is output to the controller 19. Further, the pressure and the flow rate of the hydraulic pump are detected by the pressure detection sensor and the flow rate detection sensor, and the detected values are output to the controller 19 (S1000).

At S2000, the hydraulic fluid temperature that is input to the controller 19 and the predetermined hydraulic fluid temperature are compared with each other. If the hydraulic fluid temperature that is detected by the hydraulic fluid temperature sensor 20 is equal to or higher than the predetermined lower limit value, the processing proceeds to S3000, whereas if the hydraulic fluid temperature that is detected by the hydraulic fluid temperature sensor 20 is lower than the predetermined lower limit value, the processing proceeds to S5000.

At S3000, the hydraulic fluid temperature that is input to the controller 19 and the predetermined hydraulic fluid temperature are compared with each other. If the hydraulic fluid temperature that is detected by the hydraulic fluid temperature sensor 20 is equal to or lower than the predetermined upper limit value, the processing proceeds to S4000, whereas if the hydraulic fluid temperature that is detected by the hydraulic fluid temperature sensor 20 is higher than the predetermined upper limit value, the processing proceeds to S5000.

At S4000, if the hydraulic fluid temperature that is input to the controller 19 belongs to a certain temperature range between the predetermined lower limit value and the predetermined upper limit value, the controller 19 determines that the hydraulic fluid temperature of the hydraulic fluid is at a normal level. Accordingly, the controller 19 calculates the torque in accordance with the discharge flow rate and the pressure of the hydraulic pump 12 that are detected by the pressure detection sensor and the flow rate detection sensor, and outputs the control signal according to the calculated torque value to the hydraulic pump regulator so as to limit the discharge flow rate of the hydraulic pump 12 to the predetermined flow rate.

At S5000, if the hydraulic fluid temperature that is input to the controller 19 is equal to or lower than the predetermined lower limit value (S2000) or is equal to or higher than the predetermined upper limit value (S3000), the controller 19 determines that the hydraulic fluid temperature of the hydraulic fluid deviates from the normal level. Accordingly, if the hydraulic fluid temperature that is input to the controller 19 is equal to or lower than the predetermined lower limit value, the controller 19 calculates the torque in accordance with the discharge flow rate and the pressure of the hydraulic pump 12 that are detected by the pressure detection sensor and the flow rate detection sensor. The controller 19 outputs the control signal according to the corrected input torque value to the hydraulic pump regulator 18 through reduction of the input torque value of the hydraulic pump 12 against the calculated torque value to the predetermined rate. Through this, the discharge flow rate of the hydraulic pump 12 is limited to or below the predetermined flow rate until the hydraulic fluid temperature that is detected in real time by the hydraulic fluid temperature sensor 20 to be input to the controller 19 exceeds the predetermined lower limit value.

Further, even if the hydraulic fluid temperature that is input to the controller 19 is equal to or higher than the predetermined upper limit value, the controller 19 calculates the torque in accordance with the discharge flow rate and the pressure of the hydraulic pump 12 that are detected by the pressure detection sensor and the flow rate detection sensor. The controller 19 outputs the control signal according to the corrected input torque value to the hydraulic pump regulator 18 through reduction of the input torque value of the hydraulic pump 12 against the calculated torque value to the predetermined rate. Through this, the discharge flow rate of the hydraulic pump 12 is limited to or below the predetermined flow rate until the hydraulic fluid temperature that is detected in real time by the hydraulic fluid temperature sensor 20 to be input to the controller 19 exceeds the predetermined lower limit value.

As described above, in the case where the hydraulic fluid temperature that is detected by the hydraulic fluid temperature sensor 20 to be input to the controller 19 is equal to or lower than the predetermined lower limit value, or equal to or higher than the predetermined upper limit value, the discharge flow rate of the hydraulic pump 12 can be limited to the predetermined flow rate by lowering the input torque of the hydraulic pump 12. At the same time, since the operator on the operator's seat is notified of the information on the hydraulic fluid temperature, the operator can take proper safety measures.

Although the present invention has been described with reference to the preferred embodiments in the attached figures, it is noted that equivalents may be employed and substitutions made herein without departing from the scope of the invention as recited in the claims.

INDUSTRIAL APPLICABILITY

According to the present invention having the above-described configuration, since the flow rate of the hydraulic fluid that is discharged from the hydraulic pump is limited in accordance with the hydraulic fluid temperature, the hydraulic system of the equipment can be prevented from being damaged, and the oil leak can be prevented. Further, since the operator is warned this, the operator can take proper safety measures to protect the hydraulic system.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

What is claimed is:

1. A hydraulic system for a construction machine having a protection device, comprising:

a variable displacement hydraulic pump operated by an engine;

a hydraulic actuator operated by hydraulic fluid that is supplied from the hydraulic pump;

a control valve installed in a flow path between the hydraulic pump and the hydraulic actuator to control a flow rate of the hydraulic fluid that is supplied from the hydraulic pump to the hydraulic actuator;

an oil cooler installed in a return flow path from the control valve to a hydraulic fluid tank to cool the hydraulic fluid;

a hydraulic fluid temperature sensor detecting in real time a hydraulic fluid temperature of the hydraulic fluid tank;

a hydraulic pump regulator controlling a discharge flow rate of the hydraulic pump through adjustment of an inclination angle of a swash plate of the hydraulic pump; and a controller comparing the hydraulic fluid temperature detected by the hydraulic fluid temperature sensor with a predetermined hydraulic fluid temperature, and outputting a control signal to an engine revolution control device of the engine so as to limit the discharge flow rate of the hydraulic pump to or below a predetermined flow rate through adjustment of an engine revolution of the engine if the detected hydraulic fluid temperature is equal to or lower than a predetermined lower limit value, or equal to or higher than a predetermined upper limit value.

2. The hydraulic system according to claim 1, wherein the controller comprises a control means for controlling the discharge flow rate of the hydraulic pump in accordance with the hydraulic fluid temperature detected by the hydraulic fluid temperature sensor, checking the hydraulic fluid temperature in real time, and releasing the function of limiting the discharge flow rate of the hydraulic pump to or below the predetermined flow rate if the detected hydraulic fluid temperature belongs to a certain temperature range between the lower limit value and the upper limit value.

3. The hydraulic system according to claim 1, wherein the controller comprises a warning means for notifying an operator on an operator's seat of information on the hydraulic fluid temperature if the detected hydraulic fluid temperature, which is input from the hydraulic fluid temperature sensor to the controller, is equal to or lower than the predetermined lower limit value, or equal to or higher than the predetermined upper limit value.

4. The hydraulic system according to claim 3, wherein any one of an alarm, a buzzer, and a sound message is used as the warning means.

5. A hydraulic system for a construction machine having a protection device, comprising:

a variable displacement hydraulic pump;

a hydraulic actuator operated by hydraulic fluid that is supplied from the hydraulic pump;

a control valve installed in a flow path between the hydraulic pump and the hydraulic actuator to control a flow rate of the hydraulic fluid that is supplied from the hydraulic pump to the hydraulic actuator;

an oil cooler installed in a return flow path from the control valve to a hydraulic fluid tank to cool the hydraulic fluid;

a hydraulic fluid temperature sensor detecting in real time a hydraulic fluid temperature of the hydraulic fluid tank;

a hydraulic pump regulator controlling a discharge flow rate of the hydraulic pump through adjustment of an inclination angle of a swash plate of the hydraulic pump;

a pressure detection sensor detecting pressure of the hydraulic pump;

a flow rate detection sensor detecting the discharge flow rate of the hydraulic pump; and a controller comparing the hydraulic fluid temperature detected by the hydraulic fluid temperature sensor with a predetermined hydraulic fluid temperature, calculating a torque in accordance with the detected discharge flow rate and pressure of the hydraulic pump if the detected hydraulic fluid temperature is equal to or lower than a predetermined lower limit value, or equal to or higher than a predetermined upper limit value, and outputting a control signal to the hydraulic pump regulator so as to limit the discharge flow rate of the hydraulic pump to or below a predetermined flow rate through reduction of an input torque value of the hydraulic pump against the calculated torque value with a predetermined ratio.

6. The hydraulic system according to claim 5, wherein the controller comprises a control means for controlling the discharge flow rate of the hydraulic pump in accordance with the hydraulic fluid temperature detected by the hydraulic fluid temperature sensor, checking the hydraulic fluid temperature in real time, and releasing the function of limiting the discharge flow rate of the hydraulic pump to or below the predetermined flow rate if the detected hydraulic fluid temperature belongs to a certain temperature range between the lower limit value and the upper limit value.

7. The hydraulic system according to claim 5, wherein the controller comprises a warning means for notifying an operator on an operator's seat of information on the hydraulic fluid temperature if the detected hydraulic fluid temperature, which is input from the hydraulic fluid temperature sensor to the controller, is equal to or lower than the predetermined lower limit value, or equal to or higher than the predetermined upper limit value.

8. The hydraulic system according to claim 7, wherein any one of an alarm, a buzzer, and a sound message is used as the warning means.

* * * * *